United States Patent [19]

DeJonge

[11] Patent Number: 4,802,438

[45] Date of Patent: Feb. 7, 1989

[54] CONTAINER COLLAR DOSAGE TIME INDICATOR AND CONTAINER

[76] Inventor: Antonia R. DeJonge, R.D. #1 Lilac Dr., Annandale, N.J. 08801

[21] Appl. No.: 173,243

[22] Filed: Mar. 24, 1988

[51] Int. Cl.[4] ..... B65D 55/22; G09F 9/00

[52] U.S. Cl. ..... 116/308; 206/534; 215/203

[58] Field of Search ..... 116/308, 294; 215/203, 215/219, 220

[56] References Cited

U.S. PATENT DOCUMENTS

| | | | |
|---|---|---|---|
| 2,066,183 | 12/1936 | Mehaffey | 116/121 |
| 2,111,637 | 3/1938 | Mehaffey | 116/121 |
| 3,151,599 | 10/1964 | Livingston | 116/121 |
| 3,349,935 | 10/1967 | Cochin | 215/9 |
| 3,705,662 | 12/1972 | Gach | 215/220 |
| 3,766,882 | 10/1973 | Babbitt | 116/121 |
| 4,501,370 | 2/1985 | Kelley | 215/219 |
| 4,511,050 | 4/1985 | Nicol | 215/219 |
| 4,548,157 | 10/1985 | Hevoyan | 215/111 |
| 4,705,182 | 11/1987 | Newel-Lewis | 116/308 X |
| 4,749,093 | 6/1988 | Trick | 116/308 X |

*Primary Examiner*—Daniel M. Yasich
*Attorney, Agent, or Firm*—Kenneth P. Glynn

[57] ABSTRACT

This application is directed to an invention which involves a medicine bottle which includes: (a) a container having a bottom, a side wall structure, with a shoulder section of said side wall structure tapering inwardly and upwardly towards a neck, a neck with a cross sectional area less than that of the side wall structure, said neck having a generally cylindrical configuration, a cap engagement means about said neck, an opening at the top of said neck, a circular flange about said neck below said cap engagement means, said circular flange having a specific outer diameter, and a fixed container marker located on said side wall structure; (b) a cap capable of engagement with said cap engagement means of said container; and, (c) a tapered collar having a top diameter and a bottom diameter wherein said top diameter is narrower than said bottom diameter, said top diameter being slightly less than the outer diameter of said circular flange and said bottom diameter being less than the greatest width of said shoulder, having a height sufficient to enable it to be force fitted onto said container neck over said flange and held under said flange and rotatably rested on said shoulder, said tapered collar having been force fitted over said flange and being held under said flange and rotatably resting on said shoulder, and said tapered collar having serial indicia located on its outside for rotation of said tapered collar in alignment with said fixed container marker for dosage time indication.

16 Claims, 2 Drawing Sheets

CONTAINER COLLAR DOSAGE TIME INDICATOR AND CONTAINER

BACKGROUND OF THE INVENTION

1. Field of the Invention

The present invention relates to medicine bottles for pills, capsules, caplets and the like and to dosage time indicators relating thereto. More particularly, the present invention pertains to day or sequential dosage indicators which involve a container collar.

2. Prior Art Statement

For decades, medicine container manufacturers have developed various types of time indicators for use on the bottles which have told the ultimate users when to take the medicine. Typically, indicators manually rotated would indicate when the next dosage was to be taken and the user, upon taking the next dosage, would advance the indicator to show the next time a dosage should be taken.

For example, U.S. Pat. Nos. 2,066,183 and 2,111,637 show time indicators located on the caps of medicine bottles. Both patents disclose hours on an outer portion of the top of the cap and have indicator markers on the center top of the cap. Either the markers or the hours rotate for dosage time sequences to be indicated or "flagged" for the taking of the next dosage.

U.S. Pat. No. 3,151,599 illustrates a dosage indicator with a rotating cap having an opening or window through which a day is shown. Alternatively, a rotating central arrow is employed.

U.S. Pat. No. 3,349,935 illustrates a bottle cap having a rotating cylinder with an arrow and numerals on the neck of the bottle so that the arrow and the numerals may be sequentially rotated relative to one another.

U.S. Pat. No. 3,766,882 shows a medicine bottle with a double cap, the outer cap of which has a dosage marker and is rotatable about the bottle, and the bottle has time markings thereon.

U.S. Pat. No. 4,511,050 describes a dose indicator closure which includes a rotatable outer cap and a fixed lower cap portion. The outer cap and lower cap portion of the inner cap have complimentary contour tracks for easy usage.

In addition to the above, there have been teachings of bottle side wall indicia with movable cap markers, but these all suffer from disadvantages of difficult molding of bottle side walls and major revamping of existing bottle molds.

In summary, the prior art teaches drastic cap redesign or significant bottle side wall remolding to achieve a product which has dosage time indication. However, the present invention container and collar allows for conventional cap use and for very minor or no bottle mold changes yet results in an effective product for dosage time indication.

SUMMARY OF THE INVENTION

The present invention involves a medicine bottle which includes: (a) a container having a bottom, a side wall structure, with a shoulder section of said side wall structure tapering inwardly and upwardly towards a neck, a neck with a cross sectional area less than that of the side wall structure, said neck having a generally cylindrical configuration, a cap engagement means about said neck, an opening at the top of said neck, a circular flange about said neck below said cap engagement means, said circular flange having a specific outer diameter, and a fixed container marker located on said side wall structure; (b) a cap capable of engagement with said cap engagement means of said container; and, (c) a tapered collar having a top diameter and a bottom diameter wherein said top diameter is narrower than said bottom diameter, said top diameter being slightly less than the outer diameter of said circular flange and said bottom diameter being less than the greatest width of said shoulder, having a height sufficient to enable it to be force fitted onto said container neck over said flange and held under said flange and rotatably rested on said shoulder, said tapered collar having been force fitted over said flange and being held under said flange and rotatably resting on said shoulder, and said tapered collar having serial indicia located on its outside for rotation of said tapered collar in alignment with said fixed container marker for dosage time indication.

BRIEF DESCRIPTION OF THE DRAWINGS

The present invention is more fully appreciated when the present specification is taken in conjunction with the drawings, wherein.

DETAILED DESCRIPTION OF THE INVENTION AND DRAWINGS

As mentioned, the present invention pertains to medicine bottles for pills, capsules, caplets and the like and to dosage time indicators relating thereto. The prior art discussed above teaches various time indicator arrangements which require major changes to the caps or the containers and, in effect, a switch to alternative bottles.

The present invention medicine bottle is a modification of existing medicine bottles and in an effective and unique manner, allows for use of existing containers and caps or for use of slightly modified containers and existing caps to achieve dosage time indication.

By "dosage time" is meant the time at which a prescribed or proscribed dosage of medicine is to be taken. This could be every four or six hours or the like, daily or semi-daily, or some other periodic time frame. Thus, while the present invention is described further in conjunction with days of the week, it should be understood that this is illustrative and that numerals, letters, hours, ½ hours or other indicia could be employed without exceeding the scope of the present invention.

Figure 1:
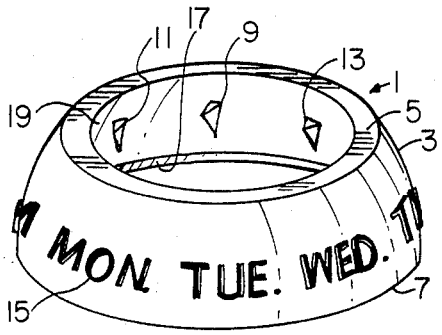
FIG. 1 shows a perspective front view of a tapered collar used in the medicine bottle of the present invention.
Figure 2:
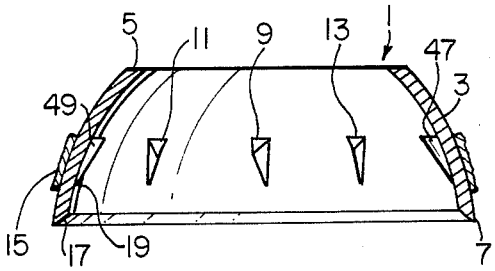
FIG. 2 shows a frontal cut view of the tapered collar of FIG. 1.
Figure 3:
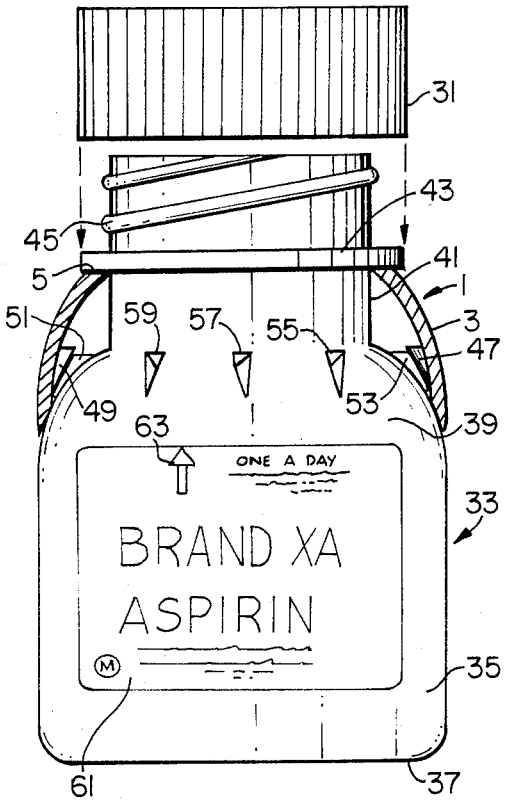
FIG. 3 shows a present invention medicine bottle with a cut view of the tapered collar of FIGS. 1 and 2 now in place on the container.

Referring now to FIGS. 1, 2 and 3, and especially to FIG. 1, there is shown a tapered collar 1, having an outside wall 3 and an inside wall 19. There is a top rim 5 having an inside diameter (hereinafter "top diameter") which is a critical dimension relative to the container 33 to which it is attached, as discussed below in conjunction with FIG. 3. A bottom rim 7 has the greatest outer diameter (hereinafter "bottom dimeter") and beveled edge 17 is shown as having an angle complimentary to the shoulder of a container. Ratchet projections 9, 11 and 13 are exemplary of a plurality of these evenly spaced about the inside wall 19. Indicia 15 are shown as days of the week.

Cut view FIG. 2 shows tapered collar 1 with outside wall 3 and inside wall 19 slightly curving inwardly and upwardly, i.e. a truncated hemisphere or dome configuration. Ratchet projections 9, 11, 3, 47 and 49 are shown and other like parts are like numbered in FIG. 1, FIG. 2 and FIG. 3.

The medicine bottle of the present invention shown in FIG. 3 comprises container 33, tapered collar 1 and cap 31. In this embodiment, container 33 has a flat bottom 37 and a side wall structure 35 which herein is cylindrical but could alternatively have a generally square or rectangular configuration. Shoulder section 39 is at the top of side wall structure 35 and tapers inwardly and upwardly towards neck 41, as shown. Neck 41 has a cross sectional area less than that of the container 33 at its side wall structure 35, i.e. it is narrower and the neck 41 has a generally cylindrical configuration for receiving a cover or cap. On this case, neck 41 has cap engagement means 45, i.e. threads, which could alternatively be beads, indentations, a lip or other cap engagement means to receive a screw cap snap-over cap snap-in cap or any other conventional or safety cap. Here, cap 31 is a conventional, non-child proof screw on type which is shown for illustrative purposes.

Neck 41 also contains a flange 43 which is typical for medicine bottles and acts as a gripping aid as well as a cap stop. Flange 43 is circular and has a specific outer diameter such that the top diameter of tapered collar 3 is at least slightly less than the outer diameter of flange 43, as shown.

Container 33 in this embodiment has ratchet projections 51, 53, 55, 57 and 59 as shown and others evenly spaced about shoulder 39 so that the plurality of ratchet projections 9, 11, 13, 47, 49 etc. on the inside of the tapered collar 1 are engageable with the aforesaid ratchet projections of shoulder 39 so as to permit rotation of the tapered collar 1 about shoulder 39 in a sequentially positioned ratchet manner. Label 61 has a fixed container marker 63 which in this case is an arrow but could be a line or other marker and could be printed or embossed on the container 33 or the label 61. Preferably it is printed on the label to facilitate the use of existing containers.

Tapered collar 1 is force fitted over neck 41 and over flange 43 so as to be held under flange 43 and rotatably rested on shoulder 39, as shown.

Figure 4:
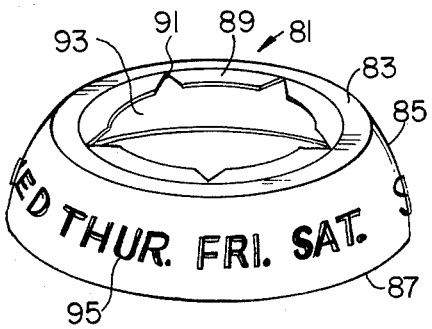
FIG. 4 illustrates an alternative tapered collar of the present invention medicine bottle without ratchet projections.

While top rim 5 of tapered collar 1 is a continuous rim, it could have slits or cut outs to facilitate its fitting over the container flange. This is illustrated in another embodiment shown in FIG. 4 wherein tapered collar 81 has outside wall 85, top rim 83 and an inner top rim 89 having cut outs exemplified by cut out 91. Also, wall 85 shows a straight taper rather than a curved taper and thus taper collar 81 has a truncated cone configuration. Also, note that no ratchet projections are shown on the inside wall 93 and this particular tapered collar 81 may be used with conventional containers like container 33 of FIG. 3 and without ratchet projections. Thus, in this embodiment top rim 83 and bottom rim 87 are tightly fitted between a flange and a shoulder of a container and rely upon this tightness for holding a particular indicia at a fixed marker. Alternatively, this truncated cone tapered collar 81 could contain ratchet projections and be used with a contained such as FIG. 3 container 33. Also, tapered collar 81 could have a short cylindrical neck extending upwardly from where top rim 83 is located to change the configuration without exceeding the scope of the present invention. Also, as mentioned, indicia such as indicia 95 could be numeric or coded instead of days of the week.

Figure 5:
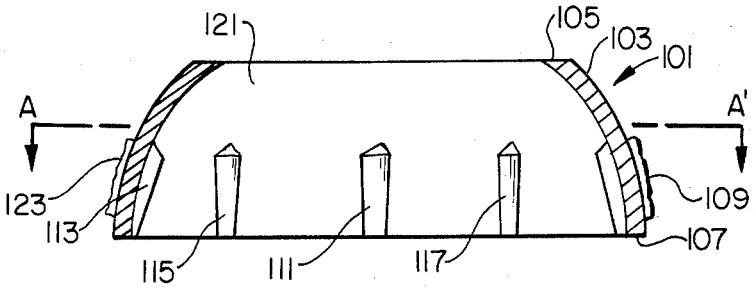
FIGS. 5 and 6 show a cut frontal and a cut top view of another tapered collar of the present invention medicine bottle.
Figure 6:
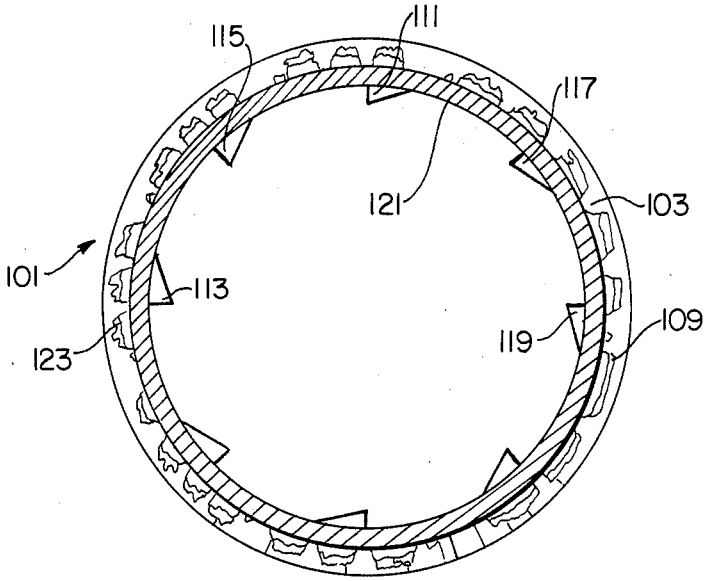

FIGS. 5 and 6 show a preferred embodiment of a tapered collar used in the present invention medicine bottle. Here, FIG. 5 shows a cut front view and FIG. 6 shows a top view cut along line AA' of FIG. 5, wherein tapered collar 101 has a truncated dome configuration, outside wall 103 and inside wall 121. Ratchet projections 111, 113, 115, 117 and 119 typify such ratchet projections located on inside wall 121 of tapered collar 101. Indicia 109 and 123 are representative indicia which are raised and unistructurally formed with tapered collar 101 during molding or casting. In this embodiment, the ratchet projections are right angled, i.e. one side of the projection is at about 90° to inside wall 121 and the other side of the projection is an obtuse angle. When these ratchet projections are used in conjunction with complimentary ratchet projections on the shoulder of a container, rotation of the collar can only be effected to advance the indicia in one direction, either clockwise or counterclockwise, and not the other.

Obviously, numerous modifications and variations of the present invention are possible in light of the above teachings. For example the tapered collar could be only very slightly tapered, i.e. just enough to fit over a flange but not easily be taken off. Further, the ratchet projections, which are optional, need not be evenly spaced about the shoulder but could involve one or more than one such projections and these could be on the collar or on the underside of the flange and yet function well. Also, the height of the tapered collar may be less than the height of the shoulder and the bottom edge may or may not be beveled. Other changes should be seen while maintaining the function and essence of the invention. It is therefore understood that within the scope of the appended claims, the invention may be practiced otherwise than as specifically described herein.

What is claimed is:

1. A medicine bottle, comprising:

(a) a container having a bottom, a side wall structure, with a shoulder section of said side wall structure tapering inwardly and upwardly towards a neck, a neck with a cross sectional area less than that of the side wall structure, said neck having a generally cylindrical configuration, a cap engagement means about said neck, an opening at the top of said neck, a circular flange about said neck below said cap engagement means, said circular flange having a specific outer diameter, and a fixed container marker located on said side wall structure;

(b) a cap capable of engagement with said cap engagement means of said container; and, (c) a tapered collar having a top diameter and a bottom diameter wherein said top diameter is narrower that said bottom diameter, said top diameter being slightly less than the outer diameter of said circular flange and said bottom diameter being less than the greatest width of said shoulder section, said tapered collar having been force and fitted over said flange and being held under said flange and rotatably resting on said shoulder section, and said tapered collar having serial indicia located on its outside for alignment with said fixed container marker for dosage time indication as said tapered collar is sequentially rotatable thereabout.

2. The medicine bottle of claim 1 wherein the tapered collar has a truncated dome configuration.

3. The medicine bottle of claim 2 wherein said serial indicia located on the outside of said tapered collar are the days of the week.

4. The medicine bottle of claim 1 wherein the tapered collar has a truncated cone configuration.

5. The medicine bottle of claim 4 wherein said serial indicia located on the outside of said tapered collar are the days of the week.

6. The medicine bottle of claim 1 wherein said fixed container marker is printed on a label attached to the side wall structure of said bottle.

7. The medicine bottle of claim 6 wherein said serial indicia located on the outside of said tapered collar are the days of the week.

8. The medicine bottle of claim 1 wherein said serial indicia located on the outside of said tapered collar are the days of the week.

9. The medicine bottle of claim 1 wherein said container has a plurality of ratchet projections located around and evenly spaced about said shoulder section and said tapered collar has a plurality of ratchet projections on its inside engageable with said ratchet projections on said shoulder section so as to enable said tapered collar to be rotated about said shoulder section in a sequentially positioned ratchet manner.

10. The medicine bottle of claim 9 wherein the tapered collar has a truncated dome configuration.

11. The medicine bottle of claim 10 wherein said serial indicia located on the outside of said tapered collar are the days of the week.

12. The medicine bottle of claim 9 wherein the tapered collar has a truncated cone configuration.

13. The medicine bottle of claim 12 wherein said serial indicia located on the outside of said tapered collar are the days of the week.

14. The medicine bottle of claim 9 wherein said fixed container marker is printed on a label attached to the side wall structure of said bottle.

15. The medicine bottle of claim 14 wherein said serial indicia located on the outside of said tapered collar are the days of the week.

16. The medicine bottle of claim 9 wherein said serial indicia located on the outside of said tapered collar are the days of the week.

* * * * *